US006354046B1

(12) United States Patent
Swearingen

(10) Patent No.: US 6,354,046 B1
(45) Date of Patent: Mar. 12, 2002

(54) SKYLIGHT MEMBRANE WITH DIVERTER

(76) Inventor: Michael R Swearingen, 6915 R.R. 2338, Georgetown, TX (US) 78628

( * ) Notice: Subject to any disclaimer, the term of this patent is extended or adjusted under 35 U.S.C. 154(b) by 0 days.

(21) Appl. No.: 09/628,955

(22) Filed: Jul. 29, 2000

(51) Int. Cl.[7] ..... E04D 13/14; E04D 1/36; E04B 7/18

(52) U.S. Cl. ..... 52/97; 52/58; 52/200; 52/219

(58) Field of Search ..... 52/200, 219, 97, 52/58

(56) References Cited

U.S. PATENT DOCUMENTS

| | | | | | |
|---|---|---|---|---|---|
| 2,800,850 | A | * | 7/1957 | McKann | 52/219 X |
| 2,875,710 | A | * | 3/1959 | Bechtold | 52/200 X |
| 3,665,661 | A | * | 5/1972 | Beckkerer | 52/200 X |
| 4,635,409 | A | * | 1/1987 | Vandemore | 52/219 X |
| 4,903,997 | A | | 2/1990 | Kifer | |
| 4,972,638 | A | | 11/1990 | Minter | |
| 5,010,700 | A | * | 4/1991 | Blair | 52/199 |
| 5,018,333 | A | | 5/1991 | Bruhm | |
| 5,094,040 | A | * | 3/1992 | Bunka | 52/200 X |
| 5,222,334 | A | | 6/1993 | Hasty | |
| 5,226,263 | A | | 7/1993 | Merrin et al. | |
| 5,291,705 | A | | 3/1994 | Dickerson | |
| 5,297,371 | A | * | 3/1994 | Borghetto | 52/200 X |
| 5,347,776 | A | * | 9/1994 | Skoff | 52/219 X |
| 5,381,632 | A | * | 1/1995 | Damron | 52/58 |
| 5,718,088 | A | * | 2/1998 | Jacobsen | 52/58 X |
| 5,860,256 | A | | 1/1999 | Humber | |
| 5,899,026 | A | | 5/1999 | WillIams et al. | |
| 6,052,956 | A | * | 4/2000 | Hoy et al. | 52/200 |
| 6,151,838 | A | * | 11/2000 | Husein | 52/58 |
| 6,155,008 | A | * | 12/2000 | McKee | 52/200 X |
| 6,212,834 | B1 | * | 4/2001 | Lindgren | 52/200 |

FOREIGN PATENT DOCUMENTS

| | | | | |
|---|---|---|---|---|
| DK | 82857 | * | 1/1957 | 52/60 |

* cited by examiner

*Primary Examiner*—Robert Canfield
(74) *Attorney, Agent, or Firm*—Michael I Kroll

(57) ABSTRACT

The present invention 10 discloses an elastomeric skylight membrane molded as a single piece comprising a planar element 18 for sealably engaging roof sheathing 26 and a centrally positioned collar element 20 for sealably engaging the rough opening framing members 34. The skylight collar membrane 20 is inserted over the framed rough opening for a skylight 16 having the elastomeric collar element tightly engaging the framing members 34 and of substantially the same height as the rough opening frame members. The planar element 18 engages the roof sheathing 26 and is fixedly attached thereto by any means well known within the art. Positioned across the up slope side 36 of the collar 20 is an angularly protruding edge 32 for preventing water from wicking between the skylight frame 34 and the skylight membrane 10. To prevent lateral flow from the up slope edge 36 of the skylight 16 there are two spaced apart ridges 22 transversely positioned to the turnback collar sides extending above and below the horizontal edge 30 of the up slope side 36. The diverter ridges 22 spaced away form the turnback side 32 obstruct lateral water flow returning it to a downhill flow. The planar element 18 further has a bead 38 on three sides near its periphery that will redirect any water that has accumulated between the skylight membrane and shingles to a downward flow.

14 Claims, 8 Drawing Sheets

SKYLIGHT MEMBRANE WITH DIVERTER

BACKGROUND OF THE INVENTION

1. Field of the Invention

The present invention relates generally to roof flashing and, more specifically, to an elastomeric skylight membrane formed as a single piece having a planar membrane element having a centrally positioned membrane collar element enclosing an aperture. The skylight membrane is inserted over the framed rough opening for a skylight having the membrane collar element tightly engaging the framing members and of substantially the same height as the rough opening framing members. The planar membrane element engages the roof sheathing and is fixedly attached thereto by any means well known within the art. In addition, a turnback edge is exteriorly positioned on the up slope side of the membrane collar element for the purpose of preventing water from wicking between the skylight frame and the skylight membrane. This is especially necessary as the slope of the roof increases.

The water which encounters the turnback side of the collar has a tendency to flow tangently. To prevent this water from traveling across the shingles, the planar membrane element has two spaced apart ridges transversely positioned to the turnback collar side. The diverter ridges spaced away from the turnback side impedes transverse water flow returning it to a downward flow.

Furthermore, positioned along three sides of the periphery of the planar membrane element is a bead that will redirect any water that has accumulated between the skylight membrane and shingles to a downward flow.

2. Description of the Prior Art

There are other elastomeric devices designed for sealing roof openings. Typical of these is U.S. Pat. No. 4,903,997 issued to Kifer on Feb. 27, 1990.

Another patent was issued to Minter on Nov. 27, 1990 as U.S. Pat. No. 4,972,638. Yet another U.S. Pat. No. 5.018,333 was issued to Bruhm et al. on May 28, 1991 and still yet another was issued on Jun. 29, 1993 to Hasty as U.S. Pat. No. 522,334.

Another patent was issued to Merrin et al. on Jul. 13, 1993 as U.S. Pat. No. 5,226,223. Yet another U.S. Pat. No. 5,291,705 was issued to Dickerson on Mar. 8, 1994. Another was issued to Thaler et al. on Sep. 8, 1998 as U.S. Pat. No. 5,802,78. Another was issued to Humber on Jan. 19, 1999 as U.S. Pat. No. 5,860,256 and still yet another was issued on May 4, 1999 to Williams et al. as U.S. Pat. No. 5,899

U.S. Pat. No 4,903,997

Inventor: David E. Kifer

Issued: Feb. 27, 1990

A roof flashing and method of making same in which both the collar and base member of the flashing are made of elastomeric material. The base member is molded first and has an opening therein surrounded by a stepped flange provided with a series of circumferential slots therein. The collar is molded onto the base member during a subsequent molding operation in which the material of the collar is injected through the slots and completely around the top, bottom and inner side edge of the flange to form a series of closed loops thus providing a positive mechanical lock between the collar and base member. Also, the heat of the elastomeric material of the collar during the second stage molding process causes some melting of the elastomeric material of the base member whereby the collar and base are also fused together.

U.S. Pat. No 4,972,638

Inventor: Mearl Minter

Issued: Nov. 27, 1990

A one piece flexible elastomer boot membrane flashing of EPDM extends from the roof upwardly around the wood base frame and over the top edge to provide a complete seal for a skylight window unit. A tape seals the outer edges of the outwardly extending peripheral lower flange portion of the boot to the roof. The skylight may be either of the fixed or ventilator type.

U.S. Pat. No 5,018,333

Inventor: Ronald Bruham et al.

Issued: May 28, 1991

A weatherseal flashing is made from sheet vulcanized rubber and surrounds a sklight frame situate on a roof curb. The weatherseal consists of a plurality of sealedly lapping panels each embodying a relatively wide apron and an upstanding flange extending along one elongated edge of the rectangular-shaped panel. The ends of each panel flange have overlapping sealedly connected wings on their ends to provide collectively, a continuous fastener for surrounding the inner side or leg of the skylight assembly to make a co-planar seal in engagement with the combined projecting curb and the skylight frame, and the roof surface.

U.S. Pat. No 5,222,334

Inventor: William E. Hasty

Issued: Jun. 29, 1993

A flashing including an elastomeric collar with an inner surface and an outer surface and adapted to seal against more than one size of a vent pipe passing vertically through a central opening in the collar. The elastomeric collar has a circular base adapted for interconnection with a base member and a central opening including, a first annular ring defined by a first separation circle and a second separation circle, at least one additional annular ring outwardly therefrom that is frangibly separable from the first annular ring at the second separation circle and frangibly separable from the elastomeric collar at a third separation circle. Each annular ring selectively is removable by a pull tab that extends vertically from the outer surface of each annular ring at a location proximate to the separation circle of that ring with respect to the elastomeric collar.

U.S. Pat. No. 5,226,263

Inventor: William R. Merrin et al.

Issued: Jul. 13, 1993

An improved device for forming a weather-tight seal to a vent pipe and over a roof flashing. The device utilizes a high durability elastomeric material with a truncated conical shape and thickened upper lip to form a rain shed over the roof flashing, thereby ensuring a tight, durable seal to the vent pipe that prevents intrusion of moisture between the vent pipe and roof flashing.

U.S. Pat. No. 5,291,705

Inventor: Gary O. Dickerson

Issued: Mar. 8, 1994

Structural support members are surrounded with a cover that insulates the outer envelope of the support member. The cover may be made of an elastomeric material sufficiently flexible to permit the cover to be physically installed about the structural member. The structural member and cover may also be provided with interlocking means that will retain the cover on the support member once it is installed. Disclosed is a skylight framework formed of a plurality of spaced rafters joined by a plurality of crossbars wherein the rafters and crossbars each include an elongated central support member having a cover member that surrounds the outer envelope of the elongated support member except for a central fastener opening.

U.S. Pat. No. 5,802,757

Inventor: Ken Thaler et al.

Issued: Sep. 8, 1998

The invention provides a resilient grommet of homogeneous elastomeric material for forming a flexible seal enveloping a top portion of a roof flashing and sealing a coaxially disposed member projecting through an open top portion of the roof flashing defining a gap therebetween, the flashing including an outwardly extending flange adjacent the open top portion thereof, the grommet comprising: a grommet body disposed about the top portion of the flashing and substantially covering the gap; mounting means for resiliently mounting an interior surface of the body about the flange of the flashing; and sealing lip means extending inwardly from a top portion of the body for resiliently sealingly engaging an exterior surface of the projecting member, U.S. Pat. No. 5,860,256

Inventor: Jeffrey A. Humber

Issued: Jan. 19, 1999

An improved two-piece roof flashing comprises a thermoplastic hard base and an elastomeric rain collar. The hard base comprises a planar base plate with a central dome like portion, with the dome-like portion having a central opening with a solid flange inwardly disposed and encircling the opening. The rain collar has a central opening sized to accommodate an upstanding roof pipe. The rain collar is molded directly onto the solid flange of the hard base, with the resulting seam between the rain collar and hard base being strong and weathertight. When the collar is molded onto the flange of the base element, the materials of the collar and flange fuse together along the seam between the collar and base element. Additionally, with the collar directly molded to the flange, the design of the flange creates a lengthy path that water must traverse in order to penetrate the roof flashing.

U.S. Pat. No. 5.899,026

Inventor: Mark F. Williams et al.

Issued: May 4, 1999

The disclosure relates to building construction flashing materials that are presented in both liquid and solid form and is useful in new building construction as well as retrofit procedures. The liquid form is comprised of a silicone base which has been reformulated to improve its flowability and self-leveling qualities allowing it to be applied by brush, pump or spray apparatus. It can be used alone or it can serve as a complementary effective moisture barrier when used with the solid form of the elastomeric flashing materials. The solid form of the elastomeric flashing materials can be extruded sheet material, formed specialty accessories, and/or a readily formable metallic substrate material which has been completely coated with the reformulated liquid silicone, resulting in a highly bendable, formable and shape retaining flashing component. Both the liquid and solid forms serve as an effective moisture guard which can be used individually or together to protect a wide range of building constructions and keep building interiors dry.

While these elastomeric devices may be suitable for the purposes for which they were designed, they would not be as suitable for the purposes of the present invention, as hereinafter described.

SUMMARY OF THE PRESENT INVENTION

The present invention discloses an elastomeric skylight membrane molded as a single piece comprising a planar element for sealably engaging roof sheathing and a centrally positioned collar element for sealably engaging the rough opening framing members. The skylight collar membrane is inserted over the framed rough opening for a skylight having the elastomeric collar element tightly engaging the framing members and of substantially the same height as the rough opening frame members. The planar element engages the roof sheathing and is fixedly attached thereto by any means well known within the art. Positioned across the up slope side of the collar is an angularly protruding edge for preventing water from wicking between the skylight frame and the skylight membrane. To prevent lateral flow from the up slope edge of the skylight there are two spaced apart ridges transversely positioned to the turnback collar sides extending above and below the horizontal edge of the up slope side. The diverter ridges spaced away form the turnback side obstruct lateral water flow returning it to a downhill flow. The planar element further has a bead on three sides near its periphery that will redirect any water that has accumulated between the skylight membrane and shingles to a downward flow.

A primary object of the present invention is to provide a one piece skylight elastomeric seal.

Another object of the present invention is to provide a skylight elastomeric member having a membrane collar element providing means for engaging the skylight framing members.

Yet another object of the present invention is to provide a skylight elastomeric member having a planar membrane element providing means for engaging the roof sheathing.

Still yet another object of the present invention is to provide a skylight elastomeric member having a membrane collar element having an angularly protruding edge extending across one side and positioned between the planar membrane element and the top collar edge.

Another object of the present invention is to provide a skylight elastomeric member having a planar membrane element having a bead extending along near the periphery of three sides. Having the fourth side open for water runoff.

Yet another object of the present invention is to provide a skylight elastomeric member having a planar roof sheathing engaging element having spaced apart ridge elements positioned above and below the up slope horizontal edge having the turnback element whereby the ridges will obstruct lateral water flow. Returning said water flow to a substantially downward flow.

Additional objects of the present invention will appear as the description proceeds.

The present invention overcomes the shortcomings of the prior art by providing an elastomeric skylight membrane molded as a single piece comprising a planar element for sealably engaging roof sheathing and a centrally positioned collar element for saleably engaging the rough opening framing members. The skylight membrane is inserted over the framed rough opening for a skylight having the elastomeric collar element tightly engaging the framing members and of substantially the same height as the rough opening framing members. The planar element engages the roof sheathing and is fixedly attached thereto by any means well known within the art.

Positioned across the up slope side of the collar is an angularly protruding edge for preventing water from wicking between the skylight frame and the skylight membrane. To prevent lateral flow from the up slope edge of the skylight there are two spaced apart ridges transversely positioned to the turnback collar side extending above and below the horizontal edge of the up slope side. The diverter ridges spaced away from the turnback side obstruct lateral water flow returning it to a downhill flow. The planar element further has a bead that will redirect any water that has accumulated between the skylight membrane and shingles to a downward flow.

The foregoing and other objects and advantages will appear from the description to follow. In the description, reference is made to the accompanying drawings, which form a part hereof, and in which is shown by way of, specific embodiments in which the invention may be practiced. These embodiments will be described in sufficient detail to enable those skilled in the art to practice the invention, and it is to be understood that other embodiments may be utilized and that structural changes may be made without departing from the scope of the invention, In the accompanying drawings, like reference characters designate the same or similar parts throughout the several views.

The following detailed description is, therefore, not to be taken in a limiting sense, an d the scope of the present invention is best defined by the appended claims

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
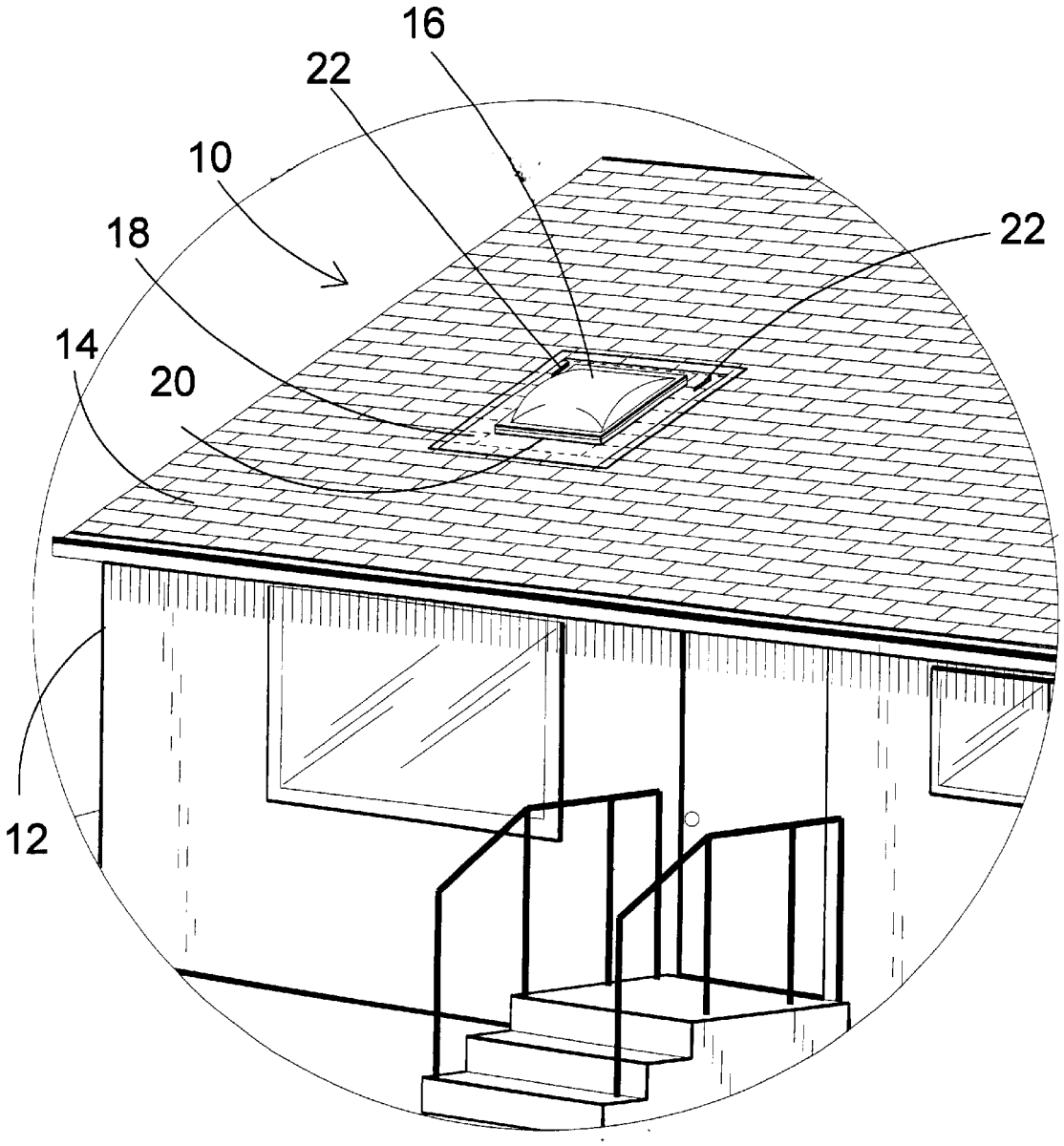
FIG. 1 is an illustrative view of the present invention installed. Shown is a pitched roof having a skylight. The skylight elastomeric membrane is installed over the skylight rough opening having a planar membrane element and collar membrane element. The collar membrane element has an angularly protruding turnback edge extending across the up slope side and spaced above the shingles. The planar membrane element has two spaced apart ridges extending above and below the turnback.

With regard to reference numerals used, the following numbering is used throughout the drawings.

10 present invention
21 house
14 roof
16skylight
18 planar membrane
20 collar element
22 diverter ridges
24 rain
26 shingles
28 direction arrow
30 upward edge of skylight
32 turnback
34 frame of skylight
36 up slope side
38 bead
40 aperture

DESCRIPTION OF THE PREFERRED EMBODIMENT(S)

In order that the invention may be more fully understood, it will now be described, by way of example, with reference to the accompanying drawings in which FIGS. 1 through 8 illustrate the present invention being a skylight membrane with a water diverter.

Turning to FIG. 1, shown therein is an illustrative view of the present invention 10 installed. Shown is a house 12 having a pitched roof 14 having a skylight. The skylight elastomeric membrane 10 is installed over the skylight rough opening having a planar membrane element 18 and collar membrane element 20. The collar membrane element 20 has an angularly protruding turnback edge (not shown) extending across the up slope side and spaced above the shingles of roof 14. The planar membrane element 18 has two spaced apart ridges 22 extending above and below the turnback.

Figure 2:
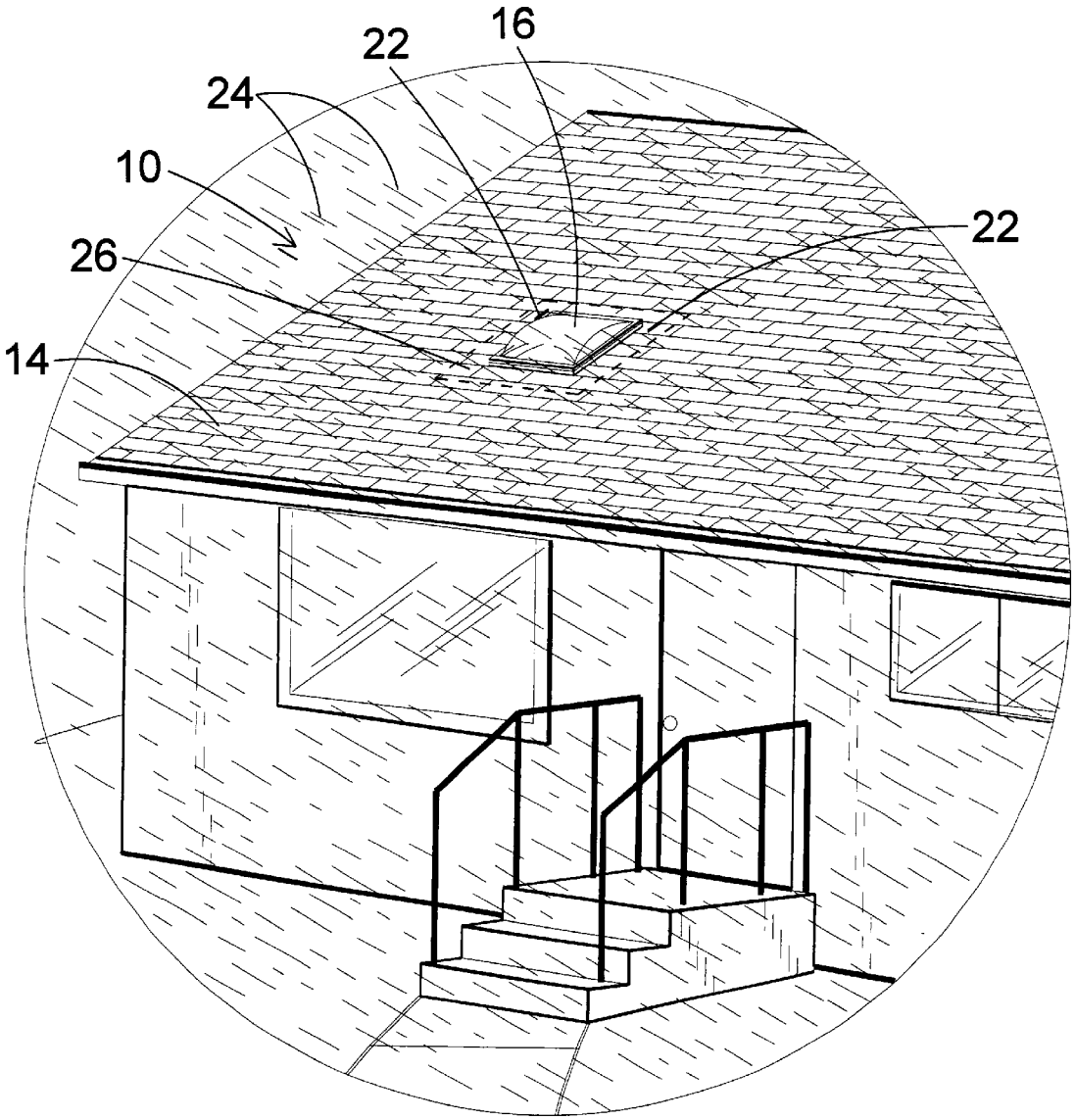
FIG. 2 is an illustrative view of the present invention showing the flow of water during a rain storm. The skylight elastomeric membrane is installed over the skylight rough opening having a planar membrane element and collar membrane element. The collar membrane element has an angularly protruding turnback edge extending across the up slope side and spaced above the shingles which prevents water from wicking between the skylight frame and the membrane collar element. The planar membrane element having two spaced apart ridges extending above and below the turnback impedes lateral flow from the collar turnback side redirecting the flow down the roof.

Turning to FIG. 2, shown therein is an illustrative view of the present invention 10 showing the flow of water during a rain storm 24. The skylight elastomeric membrane 10 is installed over the skylight 16 rough opening having a planar membrane element and collar membrane element. As previously disclosed, the collar membrane element has an angularly protruding turnback edge (not shown) extending across the up slope side and spaced above the shingles which prevents water from wicking between the skylight frame and the membrane collar element. The planar membrane element has two spaced apart ridges 22 extending above and below the turnback which impede lateral water flow from the collar turnback side redirecting the flow down the roof 14. The roof shingles 26 are shown laying over the elastomeric membrane 10 in order to form a seal over the membrane.

Figure 3:
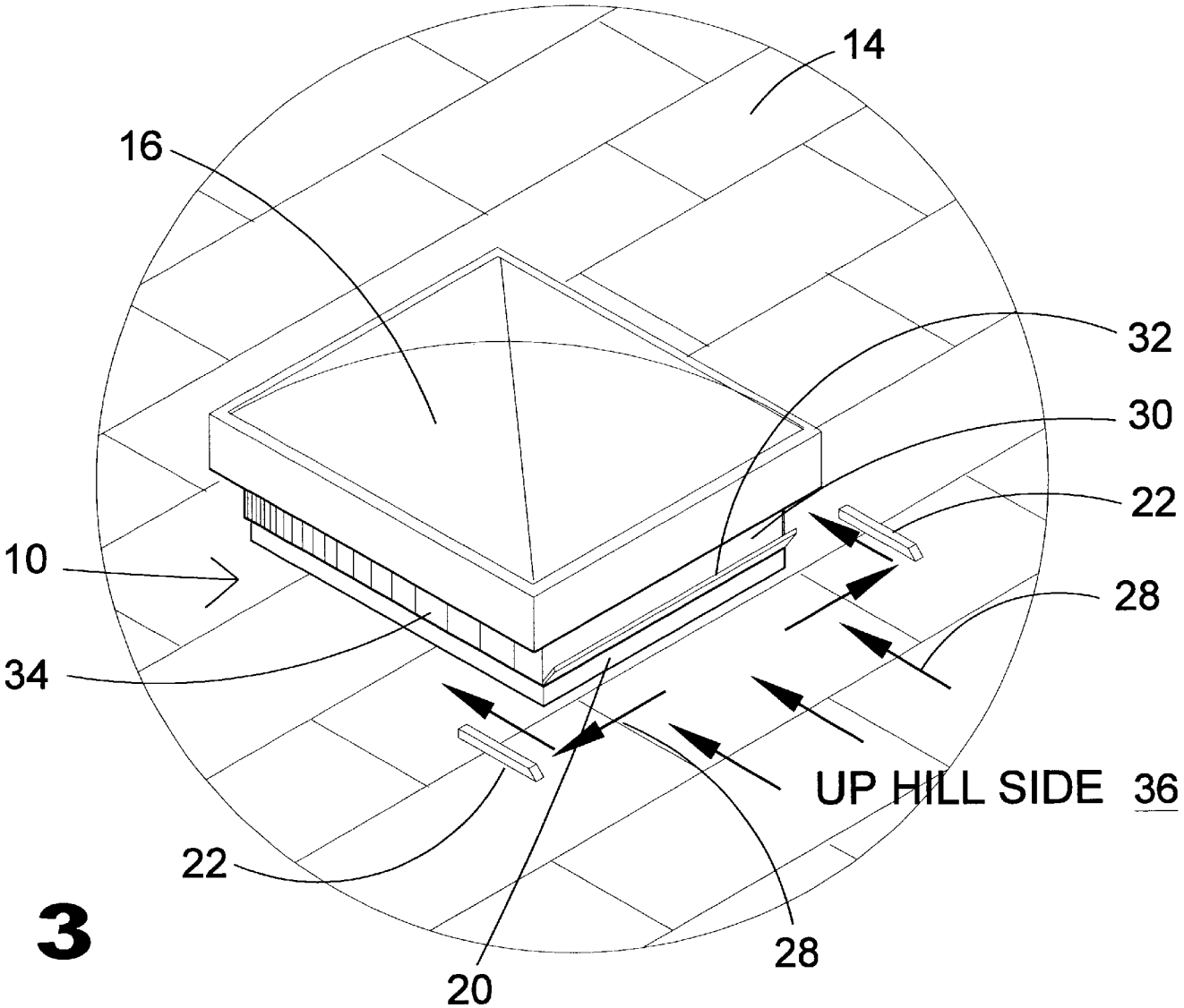
FIG. 3 is a perspective view of the present invention installed on a roof skylight showing the direction of water flow on a pitched roof. As the water cascades down a pitched roof any protrusions encountered cause the water to backup, the amount of water is a direct variable of the intensity of the rain. The large exposed edge of a skylight causes a considerable amount of blockage. This is also a more severe problem in colder climates because this edge is a natural for the formation of ice barriers. The present invention being a single formed member will prevent any seepage between the skylight and the rough framed opening within the roof. The present invention also has an angularly protruding rim extending across the up slope side of the collar to prevent any water from wicking up between the elastomeric collar element and the skylight frame. There are also ridge members spaced apart from the skylight extending above and below the horizontal line of the up slope collar surface which will prevent any lateral flow of water coming off of the up slope side.

Turning to FIG. 3, shown therein is a perspective view of the present invention 10 installed on a roof skylight 16 showing with direction arrows 28 the water flow on a pitched roof 14. As the water cascades down a pitched roof 14 any protrusions encountered cause the water to backup with the amount of water being a direct variable of the intensity of the rain. The large upward exposed edge 30 of a skylight 16 causes a considerable amount of water blockage. This is also a more severe problem in colder climates because this edge 30 is a natural for the formation of ice barriers. The present invention 10 being a single formed member will prevent any seepage between the skylight and the rough framed opening within the roof 14. The present invention 10 also has an angularly protruding rim or turnback 32 extending across the up slope side 30 of the collar 20 to prevent any water from wicking up between the elastomeric collar element 20 and the skylight frame 34. There are also multiple elongated diverter ridge members 22 spaced apart from the skylight 16 extending above and below the horizontal line of the up slope collar 20 surface which will prevent any lateral flow of water coming off of the up slope side 36. The longitudinal axis of the diverter members 22 are perpendicular to the longitudinal axis of the up slope collar 20.

Figure 4:
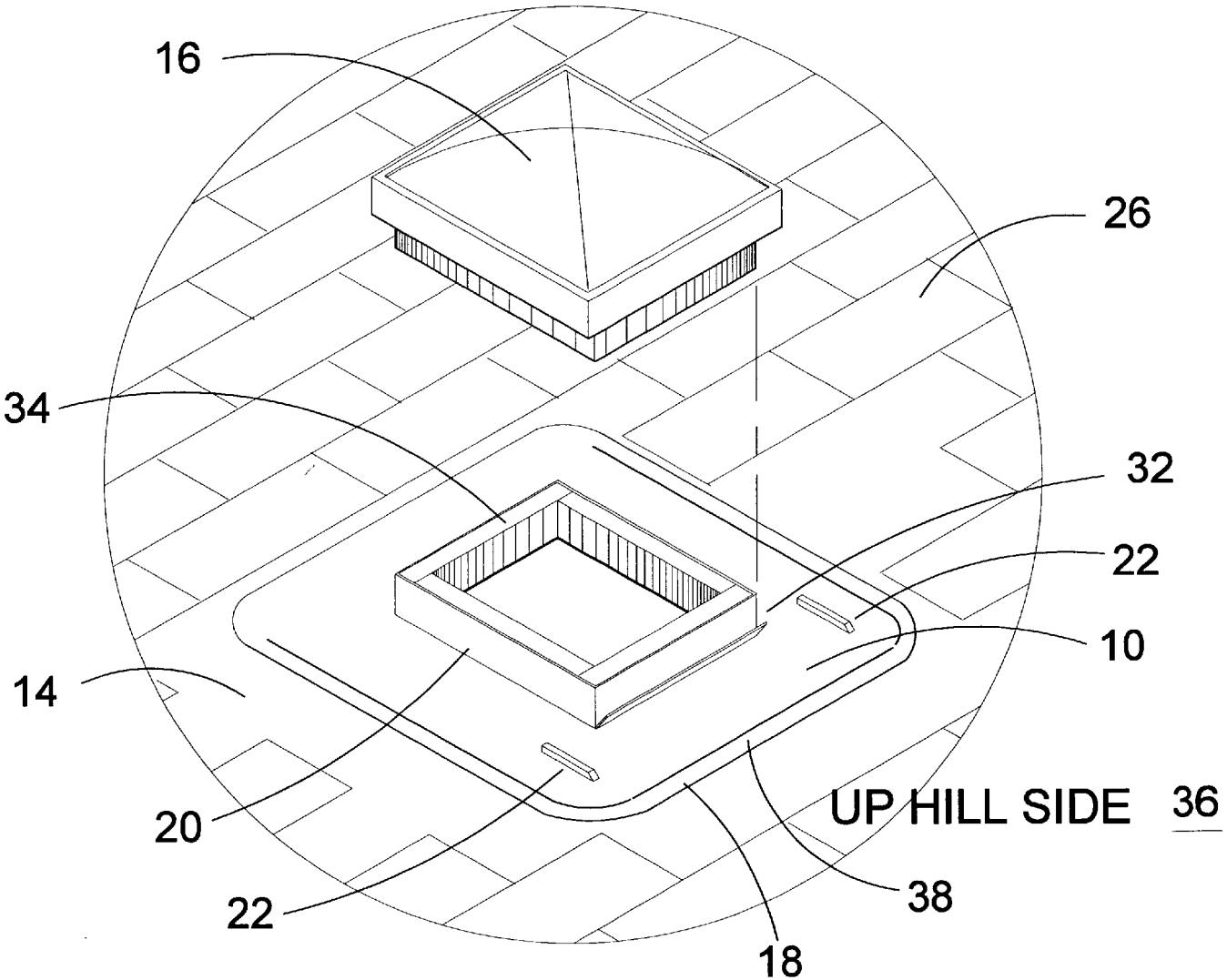
FIG. 4 is a perspective view of the present invention installed on the roof with the skylight ready to be installed. Also shown, is the skylight elastomeric member having the elastomeric collar element encompassing the skylight roof opening framing members. Also shown, is a bead positioned near the periphery of the skylight elastomeric member planar element. The bead will direct any water which is under the shingles to the sides of the skylight elastomeric planar element. Should any water get under the shingles which are positioned on the skylight elastomeric planar member, the water will be contained by the bead and flow off the lower edge that has no containment bead. Further the turnback edge and diverters will prevent any lateral water flow across the shingles.

Turning to FIG. 4, shown therein is a perspective view of the present invention 10 installed on the roof 14 with the skylight 16 ready to be installed wherein the present invention replaces the conventional tar and metal flashing method of sealing a skylight 16. Also shown, is the generally rectangular skylight elastomeric member 10 having the elastomeric collar element 20 in communication with and encompassing the skylight roof opening framing members 34. Also shown, is a bead 38 positioned near the periphery of the skylight elastomeric member planar element 18. The bead 38 will direct any water which is under the shingles 26 to the sides of the skylight elastomeric planar element 18. Should any water get under the shingles 26 which are positioned on the skylight elastomeric planar member, the water will be contained by the bead 18 and flow off the lower edge that has no containment bead. Further the turnback edge 32 located at the base of the collar member 20 and diverters 22 will prevent any lateral water flow across the shingles 26. The up slope side 36 is also shown. Turnback 32 is about ½ the length of collar 20 being disposed at an angle of about 45 degrees therewith.

Figure 5:
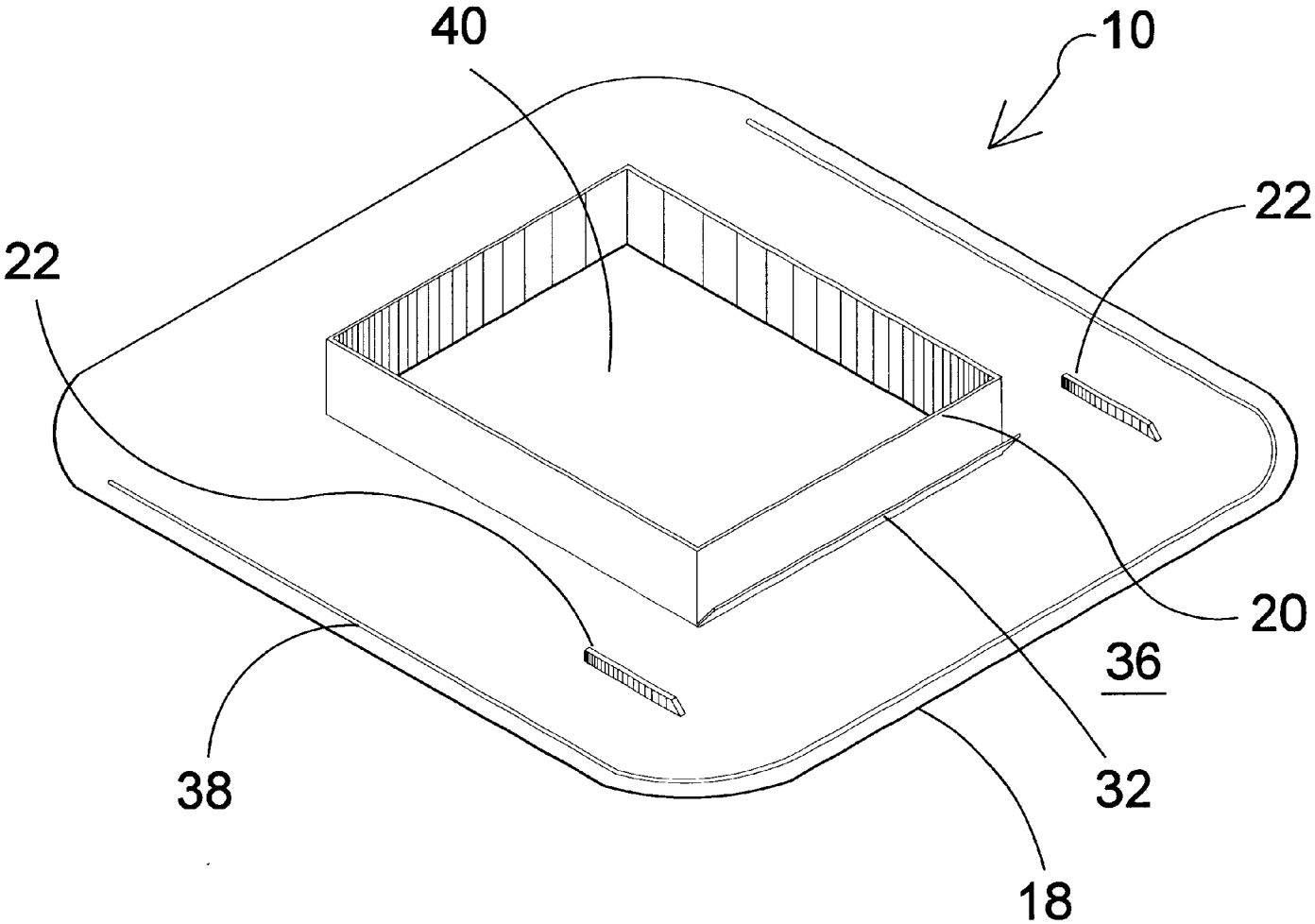
FIG. 5 is a perspective view of the present invention. Shown is an elastomeric molded member. The molded member comprises a substantially planar element that engages the roof sheathing by any means known with the art. The planar element has a centrally disposed aperture that is enclosed by a collar element. The collar element engages the framing members of the skylight opening. Also shown is the angularly protruding edge element which will prevent water from rising up the up slope edge and diverter elements which will prevent any lateral water flow from the up slope side.

Turning to FIG. 5, shown therein is a perspective view of the present invention 10 being an elastomeric molded member. The molded member comprises a substantially planar element 18 that engages the roof sheathing by any means known with the art. The planar element 18 has a centrally disposed aperture 40 that is enclosed by a collar element 20 which is about six inches in height. The collar element 20 engages the framing members of the skylight opening. Also shown is the angularly protruding edge element 32 which will prevent water from rising up the up slope edge and diverter elements 22 which will prevent any lateral water flow from the up slope side 36. Bead 38 is shown along with an approximate six inch high collar 20.

Figure 6:
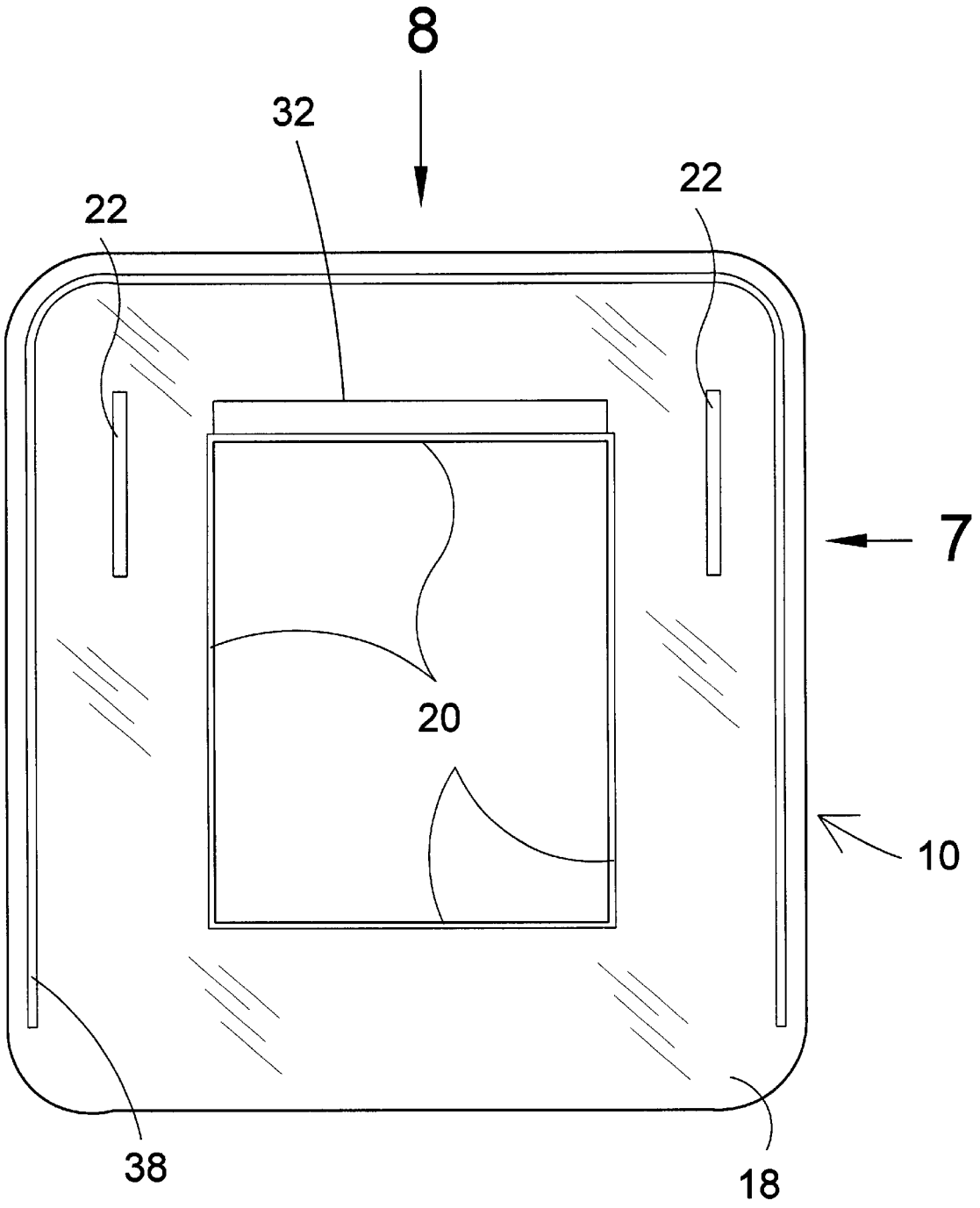
FIG. 6 shows a top view of the skylight elastomeric member. Showing the planar and collar elements that seal the skylight rough opening from the elements. Also shown are the lateral bead, diverters, and turnback that help direct water flow.

Turning to FIG. 6, shown therein is a top view of the skylight elastomeric member 10. Shown are the planar 18 and collar 20 elements that seal the skylight rough opening from the elements. Also shown are the lateral bead 38, diverters 22, and turnback 32 that help direct water flow.

Figure 7:
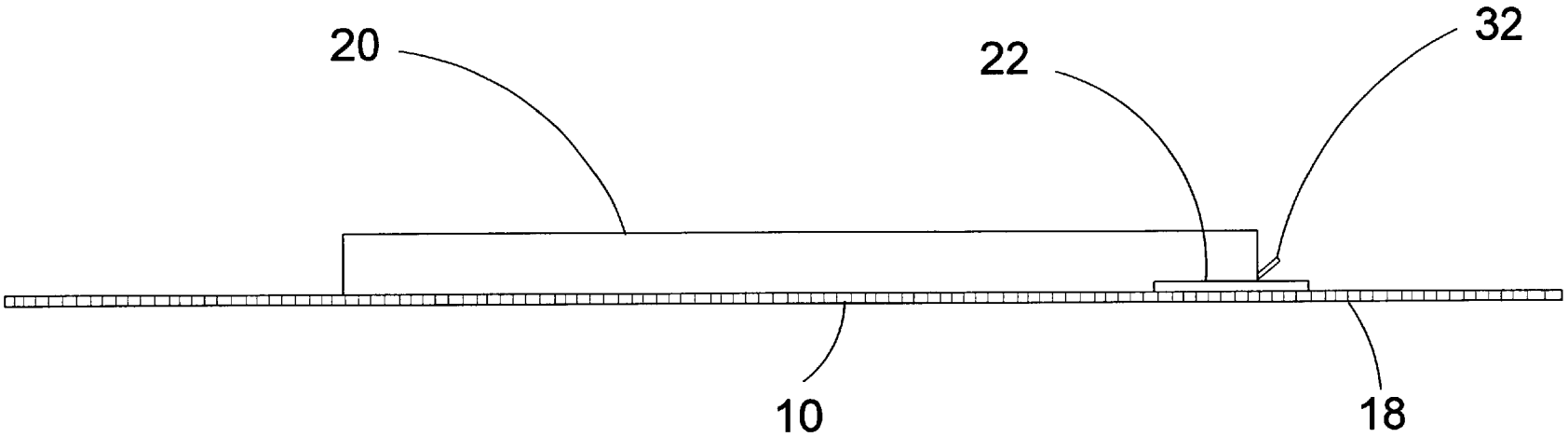
FIG. 7 is a side view of the present invention, taken from FIG. 6 as indicated. Shown is the elastomeric skylight member having a planar element for engaging the roof sheathing and a collar element for engaging the rough opening framing members. Also shown is the turnback angularly protruding edge and the diverter which extends above and below the horizontal edge of the up slope side for impeding lateral water flow from the turnback collar side.

Turning to FIG. 7, shown therein is a side view of the present invention 10, taken from FIG. 6 as indicated. Shown is the elastomeric skylight member 10 having a planar element 18 for engaging the roof sheathing and a collar element 20 for engaging the rough opening framing members. Also shown is the turnback 32 angularly protruding edge and the diverter 22 which extends above and below the horizontal edge of the up slope side for impeding lateral water flow from the turnback collar side.

Figure 8:
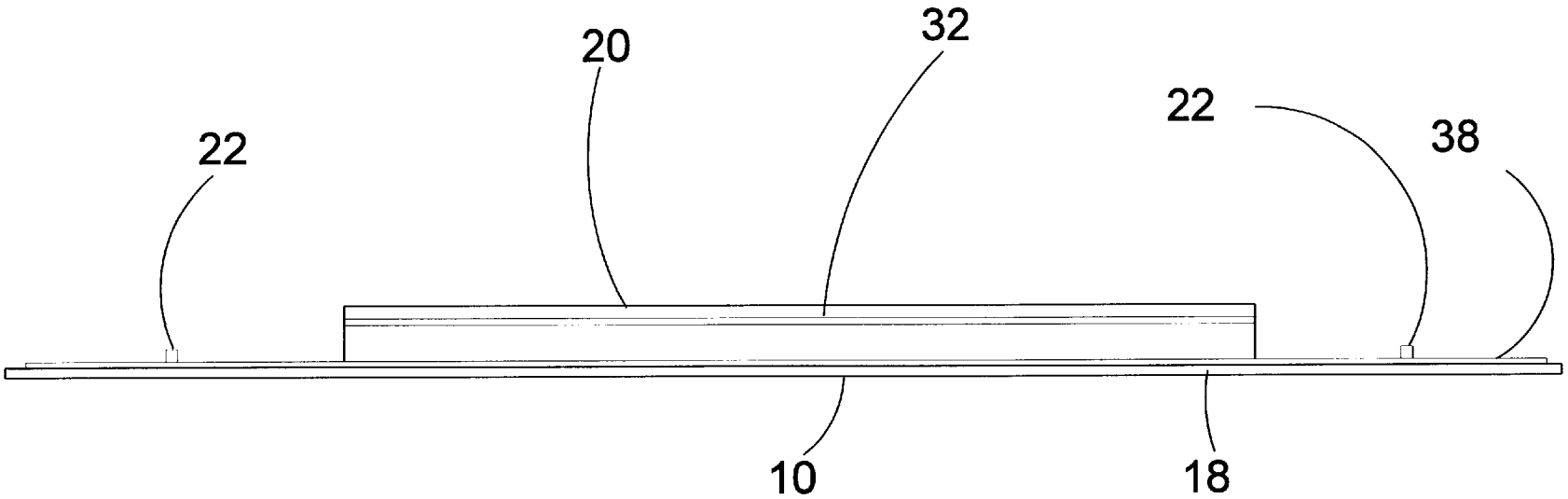
FIG. 8 is a front view side of the present invention, taken from FIG. 6 as indicated. Shown is the elastomeric skylight member having a planar element for engaging the roof sheathing and a collar element for engaging the rough opening framing members. Also shown is the turnback angularly protruding edge and the diverters that impede lateral water flow from the turnback collar side.

Turning to FIG. 8, shown therein is a front view side of the present invention 10, taken from FIG. 6 as indicated. Shown is the elastomeric skylight member 10 having a planar element 18 for engaging the roof sheathing and a collar element 20 for engaging the rough opening framing members. Also shown is the turnback 32 angularly protruding edge and the diverters 22 that impede lateral water flow from the turnback collar side. The lateral bead 38 is also shown being about as high as the planar member 18 is thick.

What is claimed to be new and desired to be protected by Letters Pat. is set forth in the appended claims.

I claim:

1. In an apparatus for a seal around an object passing through a pitched roof having shingles thereon, the roof thereby having an up slope side with respect to the object, the seal forming a flashing between the object and the roof, the object having a frame member which frame member passes through the roof, the improvement comprising:

a) a planar member having a centrally disposed aperture therein for receiving the object, said planar member having a top side and a bottom side;

b) a collar member disposed circumferentially about said aperture said collar member being in communication with the frame member, said collar member having its base disposed at its juncture with said planar member;

c) a plurality of water diverter members disposed on said top side of said planar member, said diverter members disposed lateral to said up slope side of said collar member whereby water is prevented from travelling tangentially to said up slope side of said collar member; and, d) a turnback disposed at said base of said collar member.

2. The apparatus of claim 1, said water diverter members being elongated with their longitudinal axis being disposed perpendicular to the longitudinal axis of said up slope side of said collar member.

3. The apparatus of claim 2, wherein said water diverter members extend partially above and partially below said up slope side of said collar member.

4. The apparatus of claim 1, wherein said planar member is elastomeric.

5. The apparatus of claim 1, wherein said planar member is generally rectangular shaped.

6. The apparatus of claim 1, wherein said collar member is elevated above said planar member.

7. The apparatus of claim 1, wherein said collar member extends about six inches above said planar member.

8. A. The apparatus of claim 1, wherein said turnback projects angularly from said base so as to prevent water from travelling up said collar member.

9. The apparatus of claim 8, wherein said turnback is about ½ the length of said collar member.

10. The apparatus of claim 9, wherein said turnback is disposed at angle of about 45 degrees with said collar member.

11. The apparatus of claim 1, further comprising a bead extending circumferentially about three sides of said planar member so that water is diverted around said bead.

12. The apparatus of claim 11, wherein said bead is disposed on said up slope side and said pair of lateral sides of said planar member.

13. The apparatus of claim 12, wherein said bead forms a seal between said planar member and the roof shingles.

14. The apparatus of claim 13, wherein said bead is about as high as the thickness of said planar member.

* * * * *